United States Patent [19]

Haygeman et al.

[11] 4,193,699

[45] Mar. 18, 1980

[54] WASHER AND CARRIER FOR ELONGATED OBJECTS

[76] Inventors: Drew O. Haygeman, 704 Silver Spur Rd., Rolling Hills, Calif. 90274; Robert M. Haygeman, 801 Gwenn St., Springdale, Ark. 72764

[21] Appl. No.: 893,765

[22] Filed: Apr. 5, 1978

[51] Int. Cl.[2] ..... B08B 3/04

[52] U.S. Cl. ..... 366/130; 366/349; 134/117; 150/0.5; 206/373; 215/1 C; 220/94 A; 220/375

[58] Field of Search ..... 215/1 C; 134/117, 137, 134/201, 166 R, 166 C, 182–183; 366/129–130, 341, 349; 68/96, 213; 150/0.5; 220/94 A, 375; 206/372, 373

[56] References Cited

U.S. PATENT DOCUMENTS

| | | | |
|---|---|---|---|
| 2,596,791 | 5/1952 | Rand | 68/96 X |
| 3,232,495 | 2/1966 | Schneider | 215/1 C |
| 3,280,828 | 10/1966 | Stiel | 134/166 R X |
| 3,389,712 | 6/1968 | John | 134/166 R |
| 4,036,357 | 7/1977 | Czelen | 220/375 X |

FOREIGN PATENT DOCUMENTS

| | | | |
|---|---|---|---|
| 80340 | 12/1955 | Denmark | 134/166 R |
| 511595 | 10/1971 | Switzerland | 134/117 |
| 3306 | of 1913 | United Kingdom | 134/201 |

*Primary Examiner*—Robert L. Bleutge

*Attorney, Agent, or Firm*—Fulwider, Patton, Rieber, Lee & Utecht

[57] ABSTRACT

An apparatus for washing and carrying elongated objects is provided comprising a generally elongated hollow body, having a first closable opening at one end for inserting and removing the elongated objects from a treatment zone within the body, and a second closable opening in the body for draining liquid from and permitting ventilation of the interior of the apparatus. The second opening is arranged in the body such that an elongated object cannot pass from the treatment zone out through the second opening.

3 Claims, 4 Drawing Figures

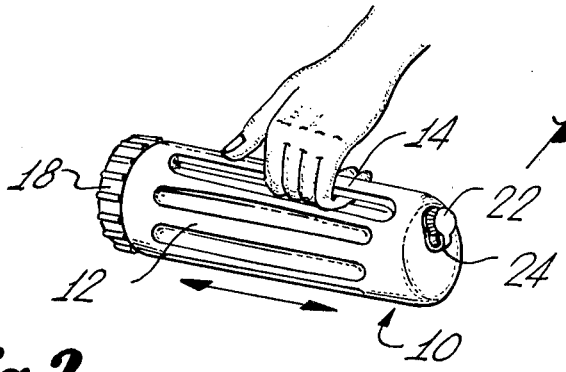
Fig. 1
Fig. 2
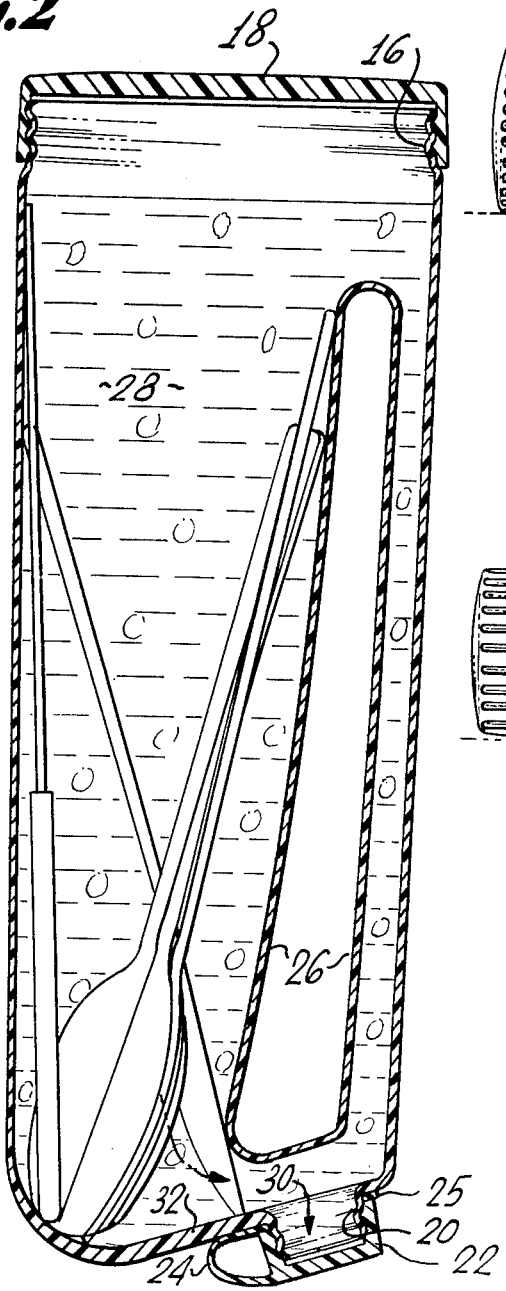
Fig. 3
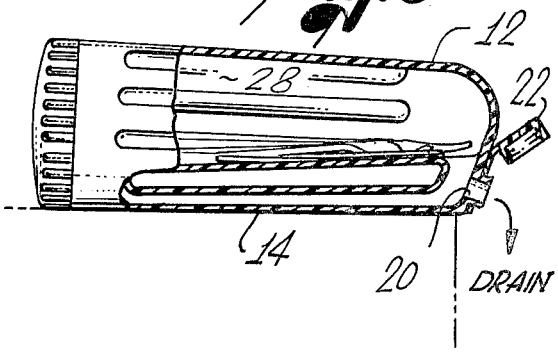
Fig. 4
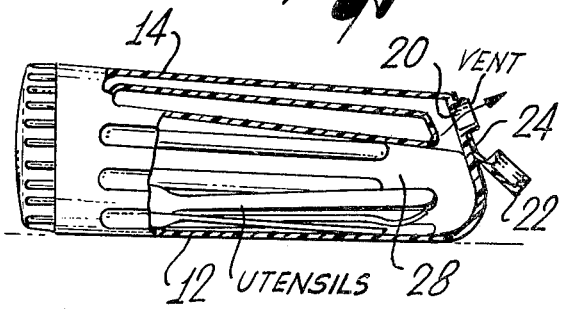

WASHER AND CARRIER FOR ELONGATED OBJECTS

BACKGROUND OF THE INVENTION

This invention relates to containers for washing or carrying objects, and more particularly, to a hand-held container for washing and carrying or storing generally elongated objects, such as flatware.

In the field of devices suitable for eating outdoors, such as while backpacking, camping, boating, etc., there has long been a problem of how to quickly and easily clean and store knives, forks, spoons and the like after use. One approach to this problem has been to employ disposable flatware, usually made of plastic. However, such utensils generally cannot be formed with the desirable sharp points and edges that can be maintained with metal utensils, and further, plastic utensils are subject to breakage and are generally less satisfactory than metal utensils for their intended uses. When produced to be strong enough to keep sharp points and edges and function properly without breakage, the plastic utensils become generally too expensive to be disposable, and therefore, metal utensils are generally preferred by those who engage in the above mentioned and similar activities.

Accordingly, there exists a need for a convenient, effective and economical device for cleaning and carrying or storing generally elongated objects such as flatware. As will become apparent from the following, the present invention satisfies that need.

SUMMARY OF THE INVENTION

The present invention resides in a new and improved container for washing and carrying or storing elongated objects such as flatware. Within the container the objects can be washed, rinsed, and without being removed from the container, stored or carried in a compartment which is ventilated through a vent opening, and the vent opening is arranged so that elongated objects cannot pass out of the container through the opening. This is accomplished generally by providing the container with a first opening through which the elongated objects can be inserted into and removed from the container, and a second opening for draining liquid from and permitting ventilation of the interior of the container.

More specifically, the second opening is arranged in the body to cooperate with the walls of the body such that the elongated objects will bear against the walls and be prevented from passing out through the second opening. In one embodiment of the invention, the second opening is located adjacent a wall partially defining a handle, and the opening and the wall combine to form a curvilinear passage through which the elongated objects cannot pass.

The handle may be formed in the body to facilitate manual operation of the container during washing and rinsing of objects within the container and to provide a convenient means for securing the container to a device upon which the container is to be carried such as a backpack. In order to enhance the useful life of the container, even when used in connection with relatively heavy objects, such as metal knives, forks, spoons and the like, the surfaces or walls of the container which are intended to impact against the objects during washing or rinsing may be formed of relatively greater thickness than the remainder of the walls of the container, thereby providing a container having a desirable light weight and extended wear life.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective exterior view of a device embodying the invention, and illustrated as normally employed for cleaning objects;

FIG. 2 is an enlarged partly sectional view of the device, and illustrated containing several elongated objects and a quantity of liquid;

FIG. 3 is a reduced elevational view of the device with part of a wall broken away and illustrated in a position for draining liquid from the device; and FIG. 4 is another reduced elevational view of the device with part of a wall broken away and illustrated in a position for storing or carrying objects.

DETAILED DESCRIPTION

As shown in the exemplary drawings, the present invention is embodied in a container, indicated generally by reference numeral 10 in FIG. 1, which is adapted for cleaning, carrying and storing generally elongated objects In this instance, the container 10 is comprised of a generally cylindrical elongated body portion 12 which includes a handle 14 for conveniently holding the container or securing it to another object such as a backpack or the like.

In order to be able to insert and remove objects from the container 10, an opening 16 (FIG. 2) is provided at one end of the container, and a cap 18 is threadably received over the opening 16. A secondary opening 20 is provided in the body portion 12 and is selectively closed by a cap 22 which is tethered to the body portion 12 by a retaining strap 24 ending in a ring 25 surrounding the exterior of the opening 20. It should be noted that although the preferred embodiment is shown in the exemplary drawings, the caps 18 and 22 may be releasably secured over the respective openings 16 and 20 by any suitable means such as by threads, by being arranged to snap on as illustrated in connection with the secondary cap 22, or by any other means desired. Further, the caps 18 and 22 may be either independent of the body 12, as illustrated in connection with the cap 18, or tethered to the body, as illustrated in connection with the cap 22. The purpose of the secondary opening 20 and cap 22 will be discussed in greater detail later.

In accordance with the present invention, the container 10 is arranged so that elongated objects or implements can be cleaned by placing them in the container with a sufficient quantity of water and vigorously shaking the container back and forth. The container can then be thoroughly drained through the secondary opening 20 without allowing the implements to escape from the container. Further, the container of the present invention can be conveniently and economically manufactured of a light weight material, and yet is capable of operating satisfactorily for cleansing relatively heavy metal implements.

The present invention is further characterized by its capacity to function as a container for storing or carrying elongated objects. In this capacity, the secondary opening 20 can remain open for proper ventilation of the container without risk of the objects being lost by passing through the opening 20.

Toward the foregoing ends, the handle 14 is formed integrally in the body portion 12 by creating a wall means 26 through the body generally along the length of the body and toward one side thereof. The outermost part of the wall 26, together with a portion of the outer wall of the body portion 12, forms the handle 14, and the inner part of the wall 26, together with the balance of the body portion 12, defines a generally elongated treatment zone 28.

In order to facilitate adequate draining and ventilation of the container 10, the secondary opening 20 is located in the body portion 12 adjacent the wall means 26. By this arrangement, the secondary opening 20 communicates with the treatment zone 28 through a generally curvilinear passage 30 (indicated by the arrows in FIG. 2), causing the elongated objects to bear against the wall 26, and preventing the objects in the treatment zone 28 from passing through the passage 30 and out of the opening 20.

In operation, with the cap 22 closing the secondary opening 20 and the cap 18 removed, any elongated objects which are desired to be cleaned, such as soiled knives, forks, spoons, etc., can be inserted into the treatment zone 28 through the opening 16 together with a sufficient quantity of water and, if desired, a cleansing agent such as a detergent. The cap 18 is then secured over the opening 16 and the contents of the device are agitated vigorously by imparting a back and forth motion to the container 10 as indicated by the arrows in FIG. 1. The action of the water within the container 10, in combination with the random collisions between the objects being cleaned, causes the objects to become cleansed, and the cap 22 may then be removed to drain the dirtied water from the container. The longitudinal back and forth motion is illustrated by way of example, and naturally, any vigorous oscillatory motion would accomplish the desired result of cleansing the soiled objects.

In order to thoroughly rinse the objects within the container the above described process may be repeated using clean water, or the cap 18 may be removed, and with the cap 22 removed from the opening 20, clean water may be caused to circulate through the container 10 either from a source of pressurized water such as a tap or by submerging the container 10 in a stream of clean water and allowing the water to flow through the container 10.

After the objects within the container have been rinsed, the container may be placed in a position to facilitate thorough draining. For this purpose, the outermost surface of the handle 14 forms a relatively flat surface upon which the container 10 may rest, and the opening 20 is located adjacent one end of that flat surface. As can best be seen in FIG. 3, this arrangement allows the container 10 to rest upon the flat exterior surface of the handle 14 to facilitate thorough draining of liquid from the container.

When used as a container for carrying or storing elongated objects, the container may be carried by hand as shown in FIG. 1, or if desired, the container may be secured to another device such as a backpack or the like. During use of the container 10 for carrying or storing objects, the cap 22 may remain removed from the secondary opening 20 for providing adequate ventilation to the interior of the container 10. By this arrangement, as can best be seen in FIG. 4, the secondary opening 20, which functioned as a drain during the cleaning and rinsing operations described above, functions as a vent opening when the container 10 is used for carrying or storing objects, and the wall means 26 serves to prevent any elongated objects being carried or stored in the container 10 from inadvertently passing from the treatment zone 28 out through the secondary opening 20.

In the preferred embodiment of the present invention, the body portion 12 can be molded of a polyethylene material as, for example, by a blow molding process, and the caps 18 and 22 can be produced by an injection molding process, ABS plastic being the presently preferred material. In this way, it is possible to control the manufacture of the body portion 12 so that the end wall 32 of the container 10 has a thickness sufficient to withstand the frequent impact of sharp metal objects such as knives, forks and the like, while the wall thickness of the remainder of the body 12 is less than the thickness of the end wall 32 in order to achieve the desirable light overall weight of the container 10. Naturally, if desired the container 10 can be fabricated of various metals such as aluminum or steel.

It will be apparent that the present device is also useful for purposes other than those described above, for example, the container 10 can be used for mixing beverages and liquid based foods. This and similar features will be appreciated by those who use the present invention in connection with the activities of backpacking or camping, which are fields of use for which this invention is particularly well suited.

From the foregoing, it will be appreciated that the container 10 provides a convenient, light weight apparatus for cleaning, carrying and storing elongated objects without risk of inadvertant loss of the objects contained. Further, the container 10 may be fabricated conveniently and economically, is trouble free and reliable in use, and may be adapted for many and varied uses.

While a particular form of the invention has been illustrated and described, it will be apparent that various modifications can be made without departing from the spirit and scope of the invention.

We claim:

1. A container for cleaning and storing elongated objects comprising:

a generally cylindrical, elongated, hollow body portion;

a wall means extending generally along the length of said body portion, spaced from the outermost surface of said body portion and cooperating therewith to form a handle, said wall means and the remainder of said body means forming a treatment zone for cleaning and storing said elongated objects;

a first opening at one end of said body portion through which said elongated objects may be inserted into and removed from said treatment zone;

a second opening in the other end of said body portion adjacent said wall means, said second opening cooperating with said wall means to prevent said elongated objects from passing from said treatment zone through said second opening;

means threadably received over said first opening for selectively opening and closing said first opening; and means secured to said body portion for selectively opening and closing said second opening.

2. A container as defined in claim 1 wherein said other end of said body portion comprises a wall having a thickness greater than the wall thickness of the remainder of the body portion.

3. A container as defined in claim 1 wherein said body portion is molded of a polyethylene thermoplastic material.

* * * * *